US011241057B2

(12) United States Patent
Bloniarz, Jr.

(10) Patent No.: US 11,241,057 B2
(45) Date of Patent: Feb. 8, 2022

(54) HEADWEAR FOR SECURING ARTICLES

(71) Applicant: Robert Mark Bloniarz, Jr., Atlanta, GA (US)

(72) Inventor: Robert Mark Bloniarz, Jr., Atlanta, GA (US)

( * ) Notice: Subject to any disclaimer, the term of this patent is extended or adjusted under 35 U.S.C. 154(b) by 0 days.

(21) Appl. No.: 15/901,534

(22) Filed: Feb. 21, 2018

(65) Prior Publication Data

US 2019/0254375 A1 Aug. 22, 2019

(51) Int. Cl.
*A42B 1/02* (2006.01)
*A42B 1/241* (2021.01)
*A42B 1/0182* (2021.01)

(52) U.S. Cl.
CPC ..... *A42B 1/02* (2013.01); *A42B 1/0182* (2021.01); *A42B 1/241* (2013.01)

(58) Field of Classification Search
CPC ..... A42B 1/02; A42B 1/214; A42B 1/24
See application file for complete search history.

(56) References Cited

U.S. PATENT DOCUMENTS 324,073 A * 8/1885 Baruch et al. ..... A42B 1/24 2/209.13
1,664,255 A * 3/1928 Lesser ..... A42B 1/24 2/195.5
1,723,276 A * 8/1929 Gottlieb ..... A63B 57/0032 224/181
4,179,753 A * 12/1979 Aronberg ..... A42B 1/247 2/10
4,451,935 A * 6/1984 Henschel ..... A42B 1/241 2/181
5,452,479 A * 9/1995 Mostert ..... A42B 1/248 2/195.1
D384,789 S 10/1997 Crabb et al.
5,860,167 A * 1/1999 Lizio ..... A42B 1/247 2/209.13
5,867,874 A 2/1999 Simpson
6,163,889 A 12/2000 Tate
6,298,495 B1 10/2001 Totani
6,647,554 B1 * 11/2003 Yan ..... A42B 1/247 2/209.13
6,671,885 B2 1/2004 Viggiano
6,792,619 B1 9/2004 Morris et al.
7,003,809 B1 * 2/2006 Gordon ..... A42B 1/241 2/209.13

(Continued)

OTHER PUBLICATIONS http://www.kccaps.com/kccapsnew/npdut_detail.asp?ID=63, KC CAP, available online, Jan. 28, 2018.

(Continued)

*Primary Examiner* — Shaun R Hurley
*Assistant Examiner* — Bao-Thieu L Nguyen
(74) *Attorney, Agent, or Firm* — Bradley D. Crose; Crose Law LLC

(57) ABSTRACT

A headwear device for securing articles includes a crown; a plurality of panels coupled together adjacently thereby to collectively form the crown; a visor attached to the crown; at least one two-ply panel disposed within the crown portion of the headwear device as a portion of the plurality of panels coupled together adjacently; and at least one aperture defined within the at least one two-ply panel thereby to form an entry point to an interior portion of the at least one two-ply panel.

16 Claims, 13 Drawing Sheets

(56) References Cited

U.S. PATENT DOCUMENTS

| | | | | |
|---|---|---|---|---|
| 7,140,047 | B2 * | 11/2006 | Kronenberger | A42B 1/24 2/209.13 |
| 7,275,270 | B2 * | 10/2007 | Cotutsca | A42B 1/24 2/209.13 |
| 7,484,845 | B2 * | 2/2009 | Douglas | A42B 1/247 2/209.13 |
| 7,904,970 | B2 * | 3/2011 | Thomas | A42B 1/247 2/195.6 |
| 7,979,921 | B2 * | 7/2011 | Cotutsca | A42B 1/247 2/209.13 |
| 8,813,265 | B2 * | 8/2014 | Schwantes | A41D 20/00 2/209.13 |
| 9,089,181 | B1 * | 7/2015 | Sigle | A42B 1/241 |
| 9,314,061 | B2 * | 4/2016 | Hanson | A42B 3/127 |
| D759,354 | S * | 6/2016 | Nail | D2/866 |
| 9,848,663 | B2 * | 12/2017 | Dunn | A42B 1/241 |
| 2006/0143776 | A1 * | 7/2006 | Hosogai | A42B 1/062 2/110 |
| 2006/0152671 | A1 * | 7/2006 | Risso | A42B 1/247 351/155 |
| 2007/0113321 | A1 * | 5/2007 | Drab | A42B 1/24 2/209 |
| 2008/0016602 | A1 * | 1/2008 | Baldwin | A42B 1/241 2/209.13 |
| 2009/0025113 | A1 * | 1/2009 | Kelleghan | A42B 1/24 2/12 |
| 2014/0230129 | A1 * | 8/2014 | Viviani | A42B 1/24 2/209.13 |
| 2016/0021962 | A1 * | 1/2016 | Lacy | A42B 1/201 2/181 |
| 2017/0216099 | A1 * | 8/2017 | Saladino | A61F 9/029 |
| 2018/0199650 | A1 * | 7/2018 | Kim | A42B 1/065 |
| 2019/0075875 | A1 * | 3/2019 | Lacy | A42B 1/247 |

OTHER PUBLICATIONS http://www.evocaps.com/, Evo Cap, available online, Jan. 28, 2018.
https://www.walmart.com/ip/Dickies-Side-Pocket-Cap/55725229?wmlspartner=wlpa&selectedSellerId=0&adid=22222222227105364888&wmlspartner=wmtlabs&wl0=&wl1=g&wl2=c&wl3=219761977580&wl4=pla-359829014852&wl5=9051852&wl6=&wl7=&wl8=&wl9=pla&wl10=8175035&wl11=online&wl12=55725229&wl13=&veh=sem, Dickies cap, available online, Jan. 28, 2018.
https://www.duluthtrading.com/store/product/duluthflex-fire-hose-cap-with-pencil-sleeve-41714.aspx?p_redirect=1&p_keyword=pencil%20cap&p_origin=24510, Duluth cap, available online, Jan. 28, 2018.
https://www.goneforarun.com/search?cgid=gfar&q=pocket+cap, Gone for a Run cap, available online, Jan. 28, 2018.

* cited by examiner

HEADWEAR FOR SECURING ARTICLES

FIELD OF THE INVENTION

The technology described herein relates generally to articles of headwear apparel having a means to attach and secure other articles. More specifically, this technology relates to an improved headwear apparatus for securing articles to the headwear. Additionally, this technology relates to an improved headwear apparatus for holding a variety of articles including eyewear, writing utensils, small tools, and other accessories on the headwear.

BACKGROUND OF THE INVENTION

Basic articles of headwear apparel are known in the background art. It is known and a common practice for individuals to wear sunglasses or other types of eyewear, particularly outdoors, to protect the eyes against the harmful rays of the sun. It is also known and common practice for individuals to further utilize headwear, such as hats, caps, visors, or headbands, for example, to provide further protection against the sun or to keep sweat off the face. It often becomes desirable to remove eyewear, such as sunglasses, for example, when entering a darkened environment. Moreover, it is common practice to utilize articles such as pencils, flashlights or tools such that it often becomes beneficial to provide a holding device for holding the eyewear or articles when they are not in use.

There are various mounting devices, systems, and methods that are utilized to couple an item to headwear. However, there are numerous deficiencies and shortcomings in the known mounting devices, systems, and methods that are utilized to couple an item to headwear.

Related utility patents and published patent applications known in the art include the following:

U.S. Pat. No. 6,163,889, issued to Tate on Dec. 26, 2000, discloses an article of clothing with embedded magnet.

U.S. Pat. No. Des. 384,789, issued to Crabb et al. on Oct. 14, 1997, discloses a cap with accessories pocket.

U.S. Pat. No. 6,298,495, issued to Totani on Oct. 9, 2001, discloses a hat including glasses retaining mechanism.

U.S. Pat. No. 5,860,167, issued to Lizio on Jan. 19, 1999, discloses headwear with receptacles.

U.S. Pat. No. 6,792,619, issued to Morris et al. on Sep. 21, 2004, discloses eyeglasses and pencil retaining assembly.

U.S. Pat. No. 5,867,874, issued to Simpson on Feb. 9, 1999, discloses an implement holder attached to a hat or cap.

U.S. Pat. No. 6,647,554, issued to Yan on Nov. 18, 2003, discloses a cap having versatile sunglass retainer and sunglass retaining method.

U.S. Pat. No. 7,140,047, issued to Kronenberger on Nov. 28, 2006, discloses a headwear piece with magnetic accessory holding assembly.

U.S. Pat. No. 7,003,809, issued to Gordon on Feb. 28, 2006, discloses a cap with a tapered exterior pocket.

U.S. Pat. No. 7,275,270, issued to Cotutsca on Oct. 2, 2007, discloses a utility holder for headwear.

U.S. Pat. No. 6,671,885, issued to Viggiano on Jan. 6, 2004, discloses a headwear for securing articles.

Related non-patent literature known in the art include the following:

KC Caps discloses its cap online as of Jan. 28, 2018, at http://www.kccaps.com/kccapsnew/npdut_detail.asp?ID=63, KC CAP.

Evocaps discloses its cap online at http://www.evocaps.com/, Evo Cap, available online, Jan. 28, 2018.

Dickies discloses its cap online as of available online, Jan. 28, 2018, at https://www.walmart.com/ip/Dickies-Side-Pocket-Cap/55725229?wmlspartner=wlpa&selectedSellerId=0&adid=22222222227105364888& wmlspartner=wmtlabs&w10=&wl1=g&w12=c&w13=219761977580&w14=pla-359829014852&w15=9051852&w16=&w17=&w18=&w19=pla&w110=8175035&wl11=online&w112=55725229&w113=&veh=sem, Dickies cap.

Duluth Trading discloses its cap online at https://www.duluthtrading.com/store/product/duluthflex-fire-hose-cap-with-pencil-sleeve-41714.aspx?p_redirect=l&p_keyword=pencil%20cap&p_origin=24510, Duluth cap, available online, Jan. 28, 2018.

Gone for a Run disclose its cap online at https://www.goneforarun.com/search?cgid=gfar&q=pocket+cap, Gone for a Run cap, available online, Jan. 28, 2018.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides an improved headwear device for securing articles.

In one exemplary embodiment, the technology described herein provides a headwear device for securing articles, including: a crown; a plurality of panels coupled together adjacently thereby to collectively form the crown; a visor attached to the crown; at least one two-ply panel disposed within the crown portion of the headwear device as a portion of the plurality of panels coupled together adjacently; and at least one aperture defined within the at least one two-ply panel thereby to form an entry point to an interior portion of the at least one two-ply panel. In various embodiments, the headwear device can include one or more panels in the crown. Examples are shown with a few panels, such as six, but, in various embodiments, the headwear device includes single panel and multi-panel versions that vary based on structure and use.

In at least one embodiment, the headwear device also includes at least two apertures defined within the at least one two-ply panel thereby to form a sleeve, wherein a first aperture defines an entry point for an object on an external side of the headwear device and wherein a second aperture defines an exit point on the external side of the headwear device such that the object is passed through the sleeve without entering an internal portion of the headwear device.

In at least one embodiment of the headwear device, the at least two apertures defined within the at least one two-ply panel thereby to form a sleeve are positioned such that the pass-through sleeve is horizontal relative to the headwear device.

In at least one embodiment, the headwear device further includes a vertical pocket, wherein the vertical pocket is defined by the at least one aperture defined within the at least one two-ply panel thereby to form an upward-facing entry point to an interior portion of the at least one two-ply panel.

In at least one embodiment of the headwear device, the at least one two-ply panel disposed within the crown portion of the headwear device as a portion of the plurality of panels coupled together adjacently further comprises an interior panel and an exterior panel, sandwiched together to collectively form a panel within the headwear device.

In at least one embodiment of the headwear device, the at least two apertures defined within the at least one two-ply panel thereby to form a sleeve are further defined with an edge seam on an external panel of the two-ply panel to add structural integrity.

In at least one embodiment of the headwear device the plurality of panels coupled together adjacently thereby to collectively form the crown also include: a right front panel; a left front panel; a right side panel; a left side panel; a right back panel; and a left back panel. The right side panel and the left side panel each are defined as a two-ply panel. The at least two apertures are defined within each of the right side panel and the left side panel, wherein a first aperture defines an entry point for an object on an external side of the headwear device and wherein a second aperture defines an exit point on the external side of the headwear device such that the object is passed through the sleeve without entering an internal portion of the headwear device.

In at least one embodiment of the headwear device the plurality of panels coupled together adjacently thereby to collectively form the crown also include: a right front panel; a left front panel; a right side panel; a left side panel; a right back panel; and a left back panel. The at least one the right side panel and the left side panel is defined as a two-ply panel. The vertical pocket defined within at least one of the right side panel and the left side panel, wherein the vertical pocket is defined by the at least one aperture defined within the at least one two-ply panel thereby to form an upward-facing entry point to an interior portion of the at least one two-ply panel.

In at least one embodiment of the headwear device the plurality of panels coupled together adjacently thereby to collectively form the crown also include: a right front panel; a left front panel; a right side panel; a left side panel; a right back panel; and a left back panel. The at least one the right side panel and the left side panel is defined as a two-ply panel. A vertical pocket defined within each of the right side panel and the left side panel, wherein the vertical pocket is defined by the at least one aperture defined within the at least one two-ply panel thereby to form an upward-facing entry point to an interior portion of the at least one two-ply panel.

In at least one embodiment of the headwear device the plurality of panels coupled together adjacently thereby to collectively form the crown also include: a right front panel; a left front panel; a right side panel; a left side panel; a right back panel; and a left back panel. At least one of the right front panel, the left front panel, the right side panel, the left side panel, the right back panel, and the left back panel is defined as a two-ply panel. The at least one panel defined as a two-ply panel comprises a vertical pocket defined within panel, wherein the vertical pocket is defined by the at least one aperture defined within the at least one two-ply panel thereby to form an upward-facing entry point to an interior portion of the at least one two-ply panel.

In at least one embodiment of the headwear device the plurality of panels coupled together adjacently thereby to collectively form the crown also include: a right front panel; a left front panel; a right side panel; a left side panel; a right back panel; and a left back panel. The right front panel and the left front panel each are defined as a two-ply panel. At least one aperture is defined within each of the right front panel and the left front panel.

In at least one embodiment of the headwear device the plurality of panels coupled together adjacently thereby to collectively form the crown also include: a right front panel; a left front panel; a right side panel; a left side panel; a right back panel; and a left back panel. The right front panel and the left front panel each are defined as a two-ply panel. At least one aperture is defined within each of the right front panel and the left front panel.

In at least one embodiment of the headwear device the plurality of panels coupled together adjacently thereby to collectively form the crown also include: a right front panel; a left front panel; a right side panel; a left side panel; a right back panel; and a left back panel. At least two of the right front panel, the left front panel, the right side panel, the left side panel, the right back panel, and the left back panel are defined as a two-ply panel. A first panel is defined as a two-ply panel comprises a vertical pocket defined within panel, wherein the vertical pocket is defined by the at least one aperture defined within the at least one two-ply panel thereby to form an upward-facing entry point to an interior portion of the at least one two-ply panel. A second panel is defined as a two-ply panel comprises at least two apertures defined within the second panel and the left side panel, wherein a first aperture defines an entry point for an object on an external side of the headwear device and wherein a second aperture defines an exit point on the external side of the headwear device such that the object is passed through the sleeve without entering an internal portion of the headwear device.

In at least one embodiment, the headwear device also includes: at least one visor two-ply panel disposed within the visor portion of the headwear device; and at least one aperture defined within the at least one visor two-ply panel thereby to form an entry point to an interior portion of the at least one visor two-ply panel.

In at least one embodiment of the headwear device, the at least one two-ply panel disposed within the crown portion of the headwear device as a portion of the plurality of panels coupled together adjacently further comprises an interior panel and an exterior panel, sandwiched together to collectively form a panel within the headwear device; and wherein the exterior panel is of a shape smaller and dissimilar in pattern, such that a portion of the interior panel is visible. Additionally, the exterior and interior panels may be of the same or dissimilar color, same or dissimilar size, same or dissimilar texture, and/or same or dissimilar material of manufacture.

In at least one embodiment, the headwear device further includes a closure on a back portion of the headwear device coupled to at least two of the plurality of panels.

In at least one embodiment, the headwear device also includes a top button disposed on the top of the crown at a point of intersection of the plurality of panels.

In at least one embodiment, the headwear device further includes a plurality of seams to couple the plurality of panels coupled together adjacently thereby to collectively form the crown.

In another exemplary embodiment, technology described herein provides a headwear device for securing articles. The headwear device includes: a crown; a right front panel; a left front panel; a right side panel; a left side panel; a right back panel; and a left back panel. The right front panel, the left front panel, the right side panel, the left side panel, the right back panel, and the left back panel are coupled together adjacently thereby to collectively form the crown. The headwear device includes a visor attached to the crown. The right side panel and the left side panel are defined as a two-ply panel comprising an interior panel and an exterior panel, sandwiched together to collectively form the two-ply panel within the headwear device. The at least two apertures are defined within each of the right side panel and the left side panel, wherein a first aperture defines an entry point for an object on an external side of the headwear device and wherein a second aperture defines an exit point on the external side of the headwear device such that the object is passed through the sleeve without entering an internal portion of the headwear device.

In yet another exemplary embodiment, technology described herein provides a headwear device for securing articles. The headwear device includes: a crown; a right front panel; a left front panel; a right side panel; a left side panel; a right back panel; and a left back panel. The right front panel, the left front panel, the right side panel, the left side panel, the right back panel, and the left back panel are coupled together adjacently thereby to collectively form the crown. The headwear device includes a visor attached to the crown. The right side panel and the left side panel are defined as a two-ply panel comprising an interior panel and an exterior panel, sandwiched together to collectively form the two-ply panel within the headwear device. A vertical pocket is defined within at least one of the right side panel and the left side panel, wherein the vertical pocket is defined by the at least one aperture defined within the at least one two-ply panel thereby to form an upward-facing entry point to an interior portion of the at least one two-ply panel.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Figure 1:
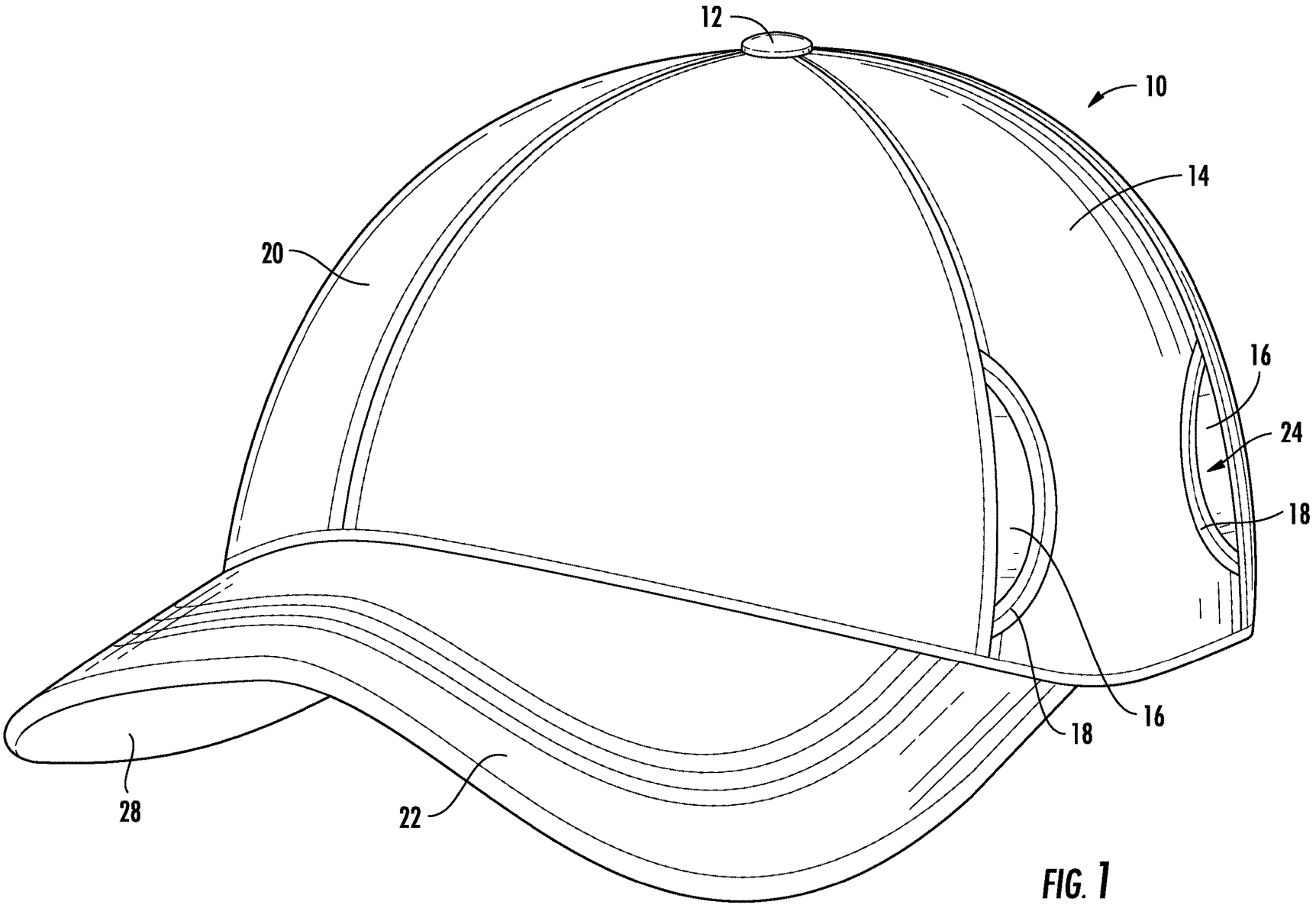
FIG. 1 is a front perspective view of an article of headwear apparel having a means to attach and secure other articles, illustrating, in particular, a horizontal pass-through sleeve constructed in a two-ply assembly of the headwear apparel, according to an embodiment of the technology described herein.
Figure 2:
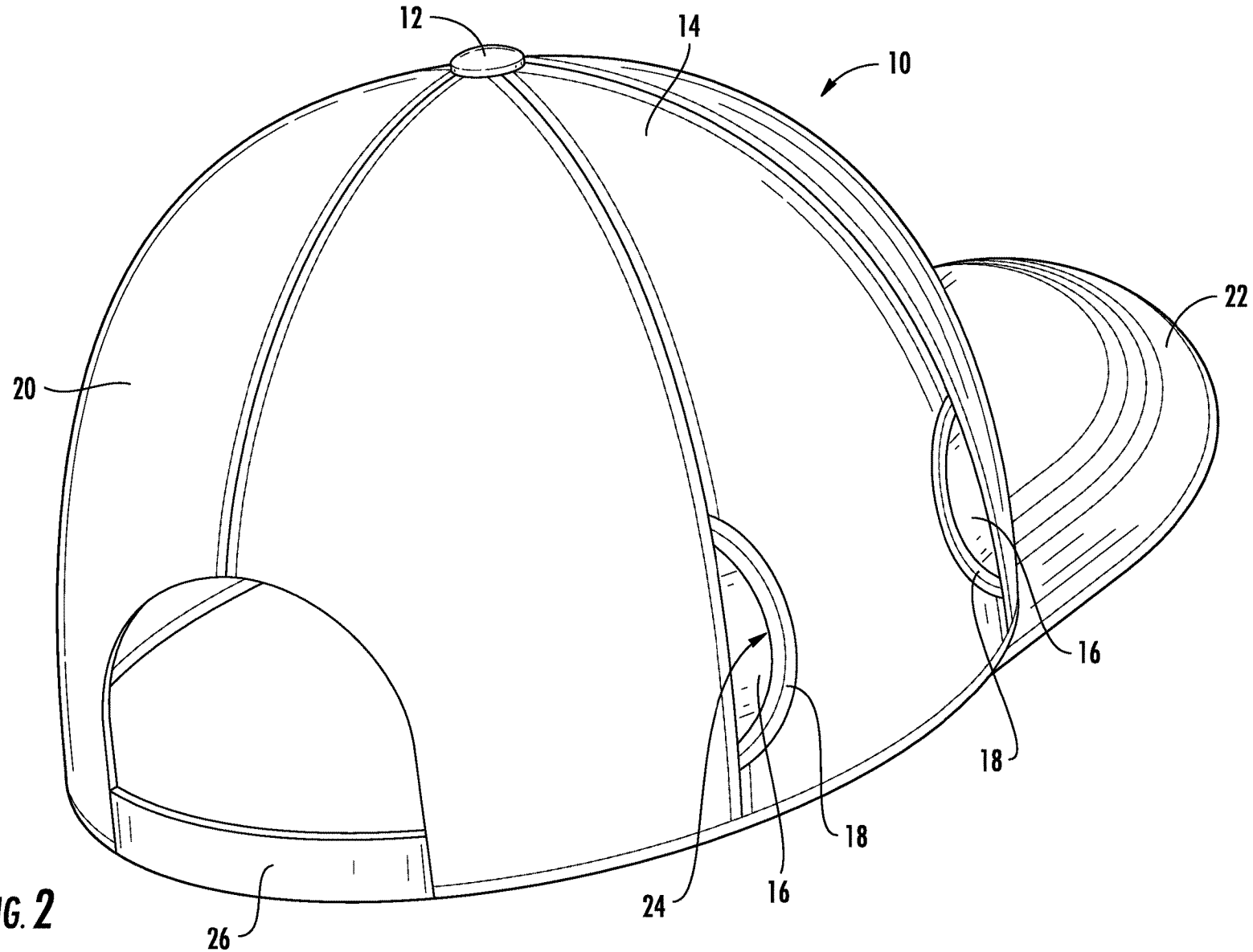
FIG. 2 is a rear perspective view of the article of headwear apparel having a means to attach and secure other articles, depicted in FIG. 1, illustrating, in particular, a horizontal pass-through sleeve constructed in a two-ply assembly of the headwear apparel, according to an embodiment of the technology described herein.
Figure 3:
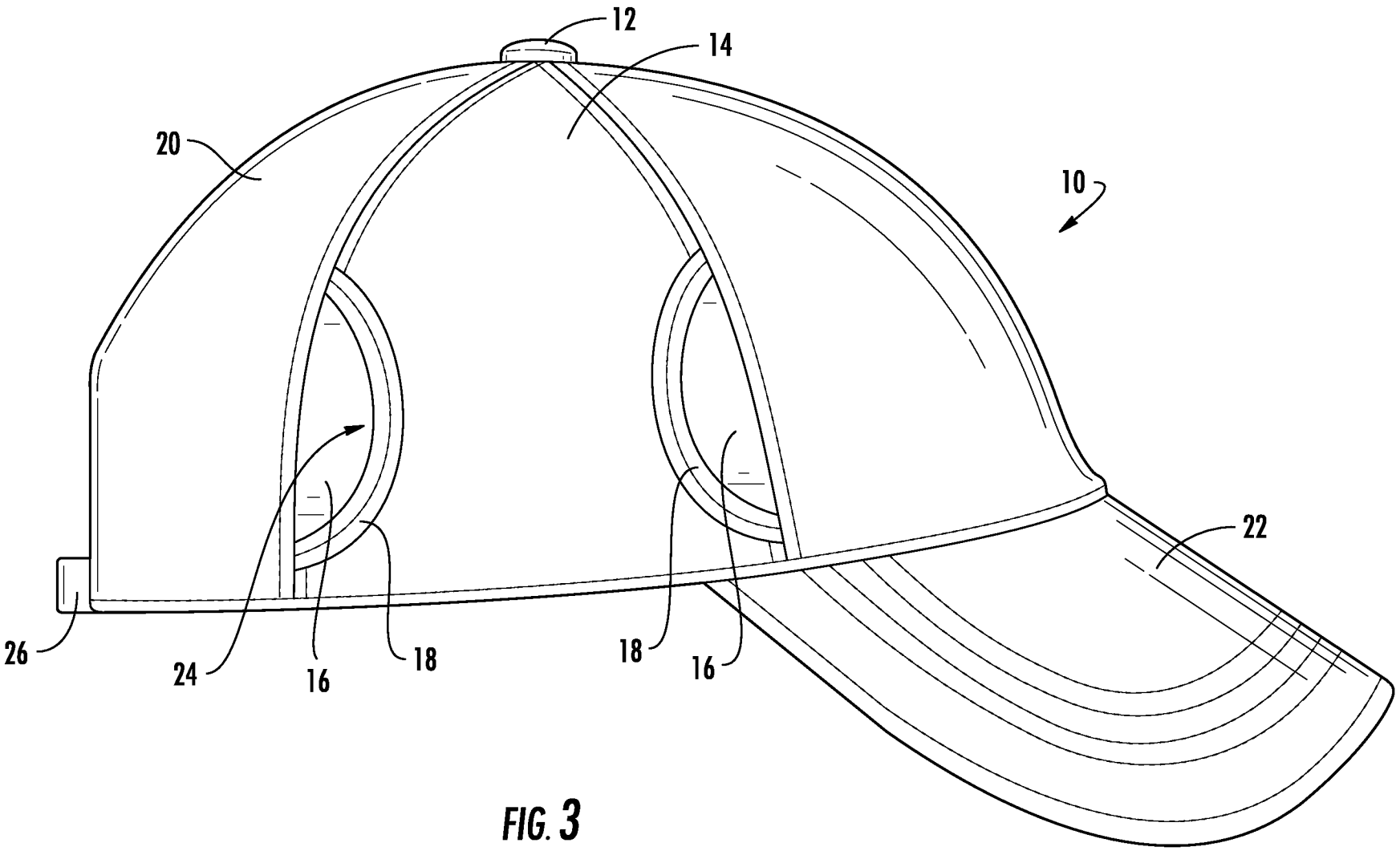
FIG. 3 is a side view of the article of headwear apparel having a means to attach and secure other articles, depicted in FIG. 1.
Figure 4:
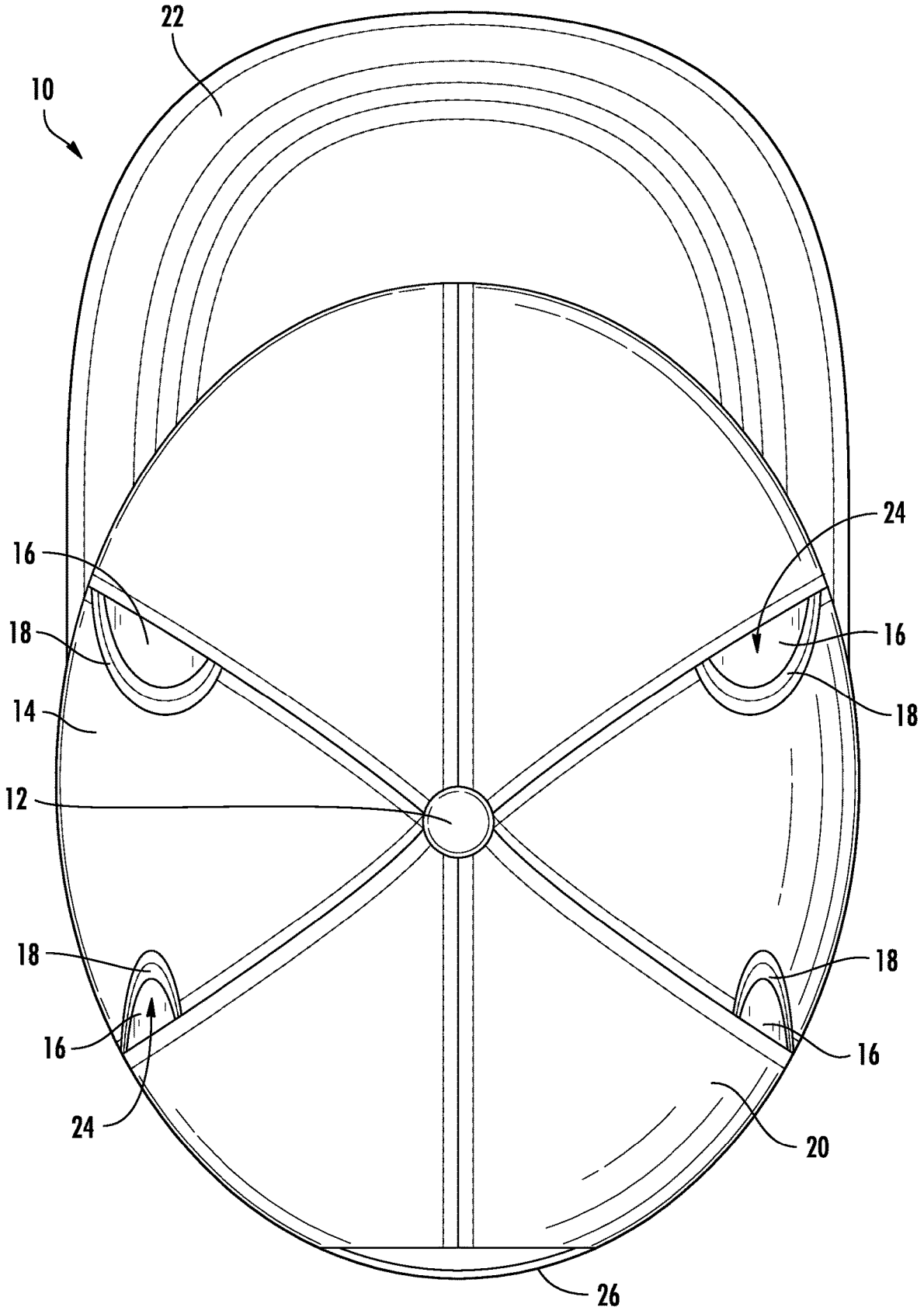
FIG. 4 is a top view of the article of headwear apparel having a means to attach and secure other articles, depicted in FIG. 1.

Before describing the disclosed embodiments of this technology in detail, it is to be understood that the technology is not limited in its application to the details of the particular arrangement shown here since the technology described is capable of other embodiments. In addition, the terminology used herein is for the purpose of description and not of limitation.

In various exemplary embodiments, the technology described herein provides an improved headwear device for securing articles, such as flashlights, pencils, vials, and the like to aid the wearer of the headwear device. The headwear device design allows for the wearer to utilize its function whether the wearer is left or right handed, or whether the headwear is worn frontward or backward. The aids not only the wearer, whether left or right handed, wearing the device, but also aid the wearer in placement of the secured item within the headwear. By way of example, a flashlight may be turned on to provide illumination in a forward and/or backward direction depending on the wearer's use and placement of one or more flashlights.

In at least one embodiment, the headwear device is a baseball style cap whose side panels are made up of two or more layers of fabric to construct a pocket or sleeve. The pocket or sleeve can serve as a holder of an object or device, just as any shirt or pants pocket serves as a holder of an object or device. Primarily the pocket or sleeve can hold a marking device, a flashlight, or any other object or paraphernalia that needs to be held.

The pocket panels are cut and positioned in a way so that the wearer can utilize the pocket or sleeve whether they are left handed or right handed and whether they are wearing the cap with the bill to the front or to the back.

By way of example in use, a person who needs a marking device within reaching distance may use the cap equipped with the pocket or sleeve to secure the marking device until it's needed. Because the marking device is secured within the pocket or sleeve on top of the wearer's head there will be no fumbling or looking for the necessary marking device.

Also, by way of example, a person who needs to use a flashlight but also needs both of their hands free to accomplish a task may use the sleeve or pocket to secure the flashlight. Because the flashlight is on top of their head and positioned with the light shining in front of themselves then the light will shine in the same direction of the wearer's eyesight.

Also, by way of example, a person who is leaving their home or car to exercise (to run, walk or hike), may utilize the pocket or sleeve to store their house or car key, an identification card, money or any other object or device they may need with them during their exercising excursion.

Further by way of example, a hunter that is walking through the woods before sun-up or after sundown with their rifle and other gear may secure a flashlight in the sleeve or pocket of the cap. The light will be positioned in the same direction as the wearer's eyesight so that the path is lit. Instead of fumbling with their rifle and gear to hold the flashlight with their hand, the cap in conjunction of the sleeved flashlight offers the hunter a way to light their path by simply turning their head. The lighted path will help them safely reach their destination.

Further by way of example, a golfer may secure their sunglasses onto the bill of their cap by inserting the earpieces of the sunglasses into the pockets or sleeves of their cap. The insertion of the earpieces inside the pockets of their cap will keep their sunglasses affixed to their cap while they are engaging in golfing activities and even swinging their golf clubs. Because the sunglasses are secured in proximity to their head they will be readily available when they are needed.

Referring now to the Figures, a headwear device 10 is shown. The headwear device 10 includes a crown formed from one panel, or from a plurality of panels, such as 20. The panels are coupled together adjacently thereby to collectively form the crown of a cap. In various embodiments, the headwear device can include one or more panels in the crown. Examples are shown with a few panels, such as six, but, in various embodiments, the headwear device includes single panel and multi-panel versions that vary based on structure and use.

The headwear device 10 includes a visor 22 attached to the crown. The visor 22 includes a top surface and an underside surface 28.

The headwear device 10 includes at least one two-ply panel, such as 14 (exterior panel) and 16 (interior panel), both the interior and exterior panels of the two-ply panel extending downwardly from the top button to a base of the headwear device, integrally formed and to share substantially a plurality of edge seams extending downwardly from the top button 12 to a base of the headwear device, disposed within the crown portion of the headwear device as a portion of the plurality of panels coupled together adjacently. In at least one embodiment, the headwear device includes a multi-ply panel with greater than two panels.

In at least one embodiment, the two-ply panel includes an interior panel made of one material, and an exterior panel made of another different material. Additionally, the exterior and interior panels may be of the same or dissimilar color, same or dissimilar size, same or dissimilar texture, and/or same or dissimilar material of manufacture. In at least one embodiment, the exterior panel is less in size than the interior panel at the at least one entry aperture and the at least one exit aperture defined within the at least one two-ply panel thereby to create at least one indentation to a portion of at least one of the plurality of edge seams defined at each of the at least one entry aperture and the at least one exit aperture and aid in ease of entry.

The headwear device 10 includes at least one aperture 24 defined within the at least one two-ply panel 14 thereby to form an entry point to an interior portion of the at least one two-ply panel 14. Through this entry point an object such as sunglasses are inserted.

In at least one embodiment, the headwear device 10 also includes at least two apertures 24 defined within the at least one two-ply panel 14 thereby to form a sleeve.

In this embodiment, a first aperture defines an entry point for an object on an external side of the headwear device 10 and wherein a second aperture defines an exit point on the external side of the headwear device 10 such that the object, such as for examples, the side portions of sunglasses or a flashlight, is passed through the sleeve without entering an internal portion of the headwear device.

In at least one embodiment of the headwear device 10, the at least two apertures 24 defined within the at least one two-ply panel thereby to form a sleeve are positioned such that the pass-through sleeve is horizontal relative to the headwear device. The horizontal nature allows for the secure placement of an item such as a pencil or flashlight.

Figure 11:
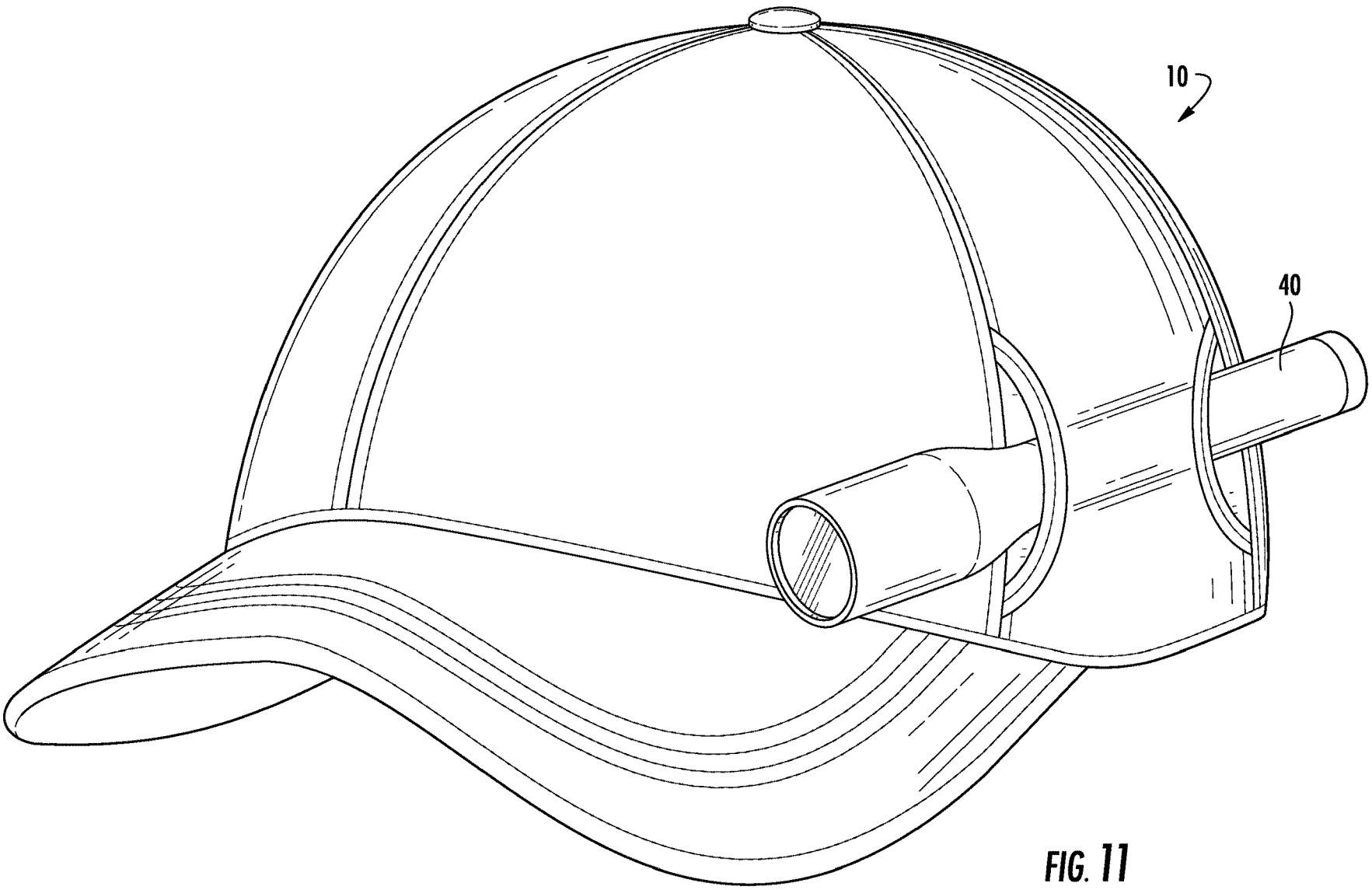
FIG. 11 is front perspective view of the article of headwear apparel having a means to attach and secure other articles, depicted in FIG. 1, illustrating, in particular, a flashlight mounted with the means to attach and secure other articles, according to an embodiment of the technology described herein.
Figure 12:
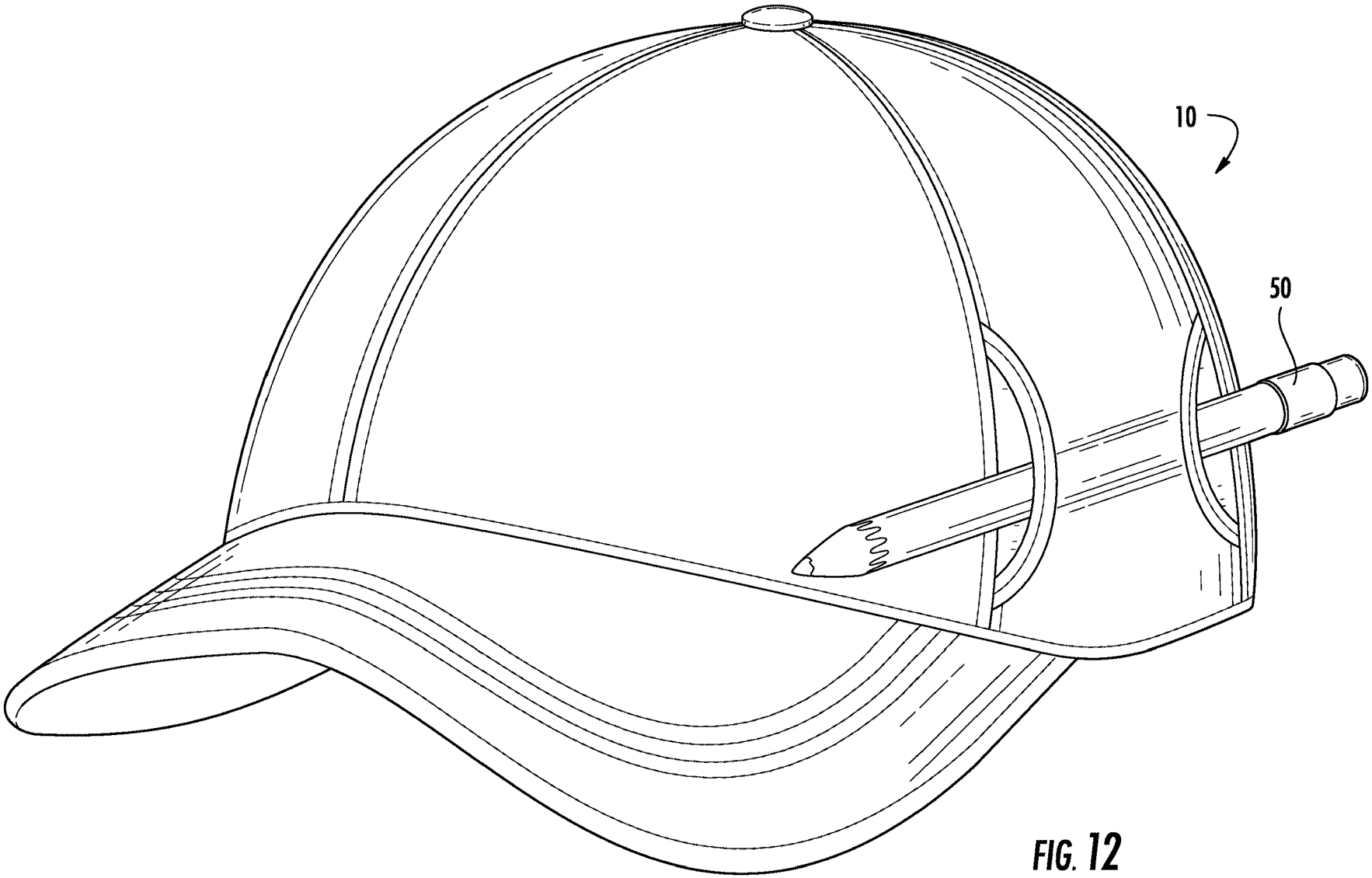
FIG. 12 is front perspective view of the article of headwear apparel having a means to attach and secure other articles, depicted in FIG. 1, illustrating, in particular, a pencil mounted with the means to attach and secure other articles, according to an embodiment of the technology described herein.

By way of example, FIGS. 11 and 12 depict on object passed through the sleeve. FIG. 11 depicts a flashlight securely fitted within the sleeve. FIG. 12 depicts a carpenter's pencil securely fitted within the sleeve.

In at least one embodiment, the headwear device further includes a vertical pocket 36, wherein the vertical pocket 36 is defined by the at least one aperture defined within the at least one two-ply panel 30, 32 thereby to form an upward-facing entry point to an interior portion of the at least one two-ply panel 30, 32.

In at least one embodiment of the headwear device 10, the at least one two-ply panel disposed within the crown portion of the headwear device as a portion of the plurality of panels coupled together adjacently further comprises an interior panel and an exterior panel 30, 32 and also 14, 16, sandwiched together to collectively form a panel within the headwear device 10.

In at least one embodiment of the headwear device 10, the at least two apertures 24 defined within the at least one two-ply panel thereby to form a sleeve are further defined with an edge seam 18, and also 34. on an external panel of the two-ply panel to add structural integrity.

In at least one embodiment of the headwear device the plurality of panels coupled together adjacently thereby to collectively form the crown also include: a right front panel; a left front panel; a right side panel; a left side panel; a right back panel; and a left back panel. The right side panel and the left side panel each are defined as a two-ply panel. The at least two apertures are defined within each of the right side panel and the left side panel, wherein a first aperture 24 defines an entry point for an object on an external side of the headwear device and wherein a second aperture 24 defines an exit point on the external side of the headwear device such that the object is passed through the sleeve without entering an internal portion of the headwear device.

In at least one embodiment of the headwear device the plurality of panels coupled together adjacently thereby to collectively form the crown also include: a right front panel; a left front panel; a right side panel; a left side panel; a right back panel; and a left back panel. The at least one the right side panel and the left side panel is defined as a two-ply panel. The vertical pocket defined within at least one of the right side panel and the left side panel, wherein the vertical pocket 36 is defined by the at least one aperture defined within the at least one two-ply panel thereby to form an upward-facing entry point to an interior portion of the at least one two-ply panel 30, 32.

In at least one embodiment of the headwear device the plurality of panels coupled together adjacently thereby to collectively form the crown also include: a right front panel; a left front panel; a right side panel; a left side panel; a right back panel; and a left back panel. The at least one the right side panel and the left side panel is defined as a two-ply panel. A vertical pocket 36 defined within each of the right side panel and the left side panel, wherein the vertical pocket is defined by the at least one aperture defined within the at least one two-ply panel thereby to form an upward-facing entry point to an interior portion of the at least one two-ply panel 30, 32.

In at least one embodiment of the headwear device the plurality of panels coupled together adjacently thereby to collectively form the crown also include: a right front panel; a left front panel; a right side panel; a left side panel; a right back panel; and a left back panel. At least one of the right front panel, the left front panel, the right side panel, the left side panel, the right back panel, and the left back panel is defined as a two-ply panel. The at least one panel defined as a two-ply panel comprises a vertical pocket 36 defined within panel, wherein the vertical pocket is defined by the at least one aperture defined within the at least one two-ply panel thereby to form an upward-facing entry point to an interior portion of the at least one two-ply panel 30, 32.

In at least one embodiment of the headwear device the plurality of panels coupled together adjacently thereby to collectively form the crown also include: a right front panel; a left front panel; a right side panel; a left side panel; a right back panel; and a left back panel. The right front panel and the left front panel each are defined as a two-ply panel. At least one aperture is defined within each of the right front panel and the left front panel.

In at least one embodiment of the headwear device the plurality of panels coupled together adjacently thereby to collectively form the crown also include: a right front panel; a left front panel; a right side panel; a left side panel; a right back panel; and a left back panel. The right front panel and the left front panel each are defined as a two-ply panel. At least one aperture is defined within each of the right front panel and the left front panel.

In at least one embodiment of the headwear device 10 the plurality of panels coupled together adjacently thereby to collectively form the crown also include: a right front panel; a left front panel; a right side panel; a left side panel; a right back panel; and a left back panel. At least two of the right front panel, the left front panel, the right side panel, the left side panel, the right back panel, and the left back panel are defined as a two-ply panel. A first panel is defined as a two-ply panel comprises a vertical pocket defined within panel, wherein the vertical pocket is defined by the at least one aperture defined within the at least one two-ply panel thereby to form an upward-facing entry point to an interior portion of the at least one two-ply panel. A second panel is defined as a two-ply panel comprises at least two apertures defined within the second panel and the left side panel, wherein a first aperture defines an entry point for an object on an external side of the headwear device and wherein a second aperture defines an exit point on the external side of the headwear device such that the object is passed through the sleeve without entering an internal portion of the headwear device.

In at least one embodiment, the headwear device 10 also includes: at least one visor two-ply panel disposed within the visor portion of the headwear device; and at least one aperture defined within the at least one visor two-ply panel thereby to form an entry point to an interior portion of the at least one visor two-ply panel.

In at least one embodiment of the headwear device 10, the at least one two-ply panel disposed within the crown portion of the headwear device as a portion of the plurality of panels coupled together adjacently further comprises an interior panel and an exterior panel, sandwiched together to collectively form a panel within the headwear device; and wherein the exterior panel is of a shape smaller and dissimilar in pattern, such that a portion of the interior panel is visible. Additionally, the exterior and interior panels may be of the same or dissimilar color, same or dissimilar size, same or dissimilar texture, and/or same or dissimilar material of manufacture.

In at least one embodiment, the headwear device further includes a closure 26 on a back portion of the headwear device coupled to at least two of the plurality of panels.

In at least one embodiment, the headwear device also includes a top button 12 disposed on the top of the crown at a point of intersection of the plurality of panels.

Figure 5:
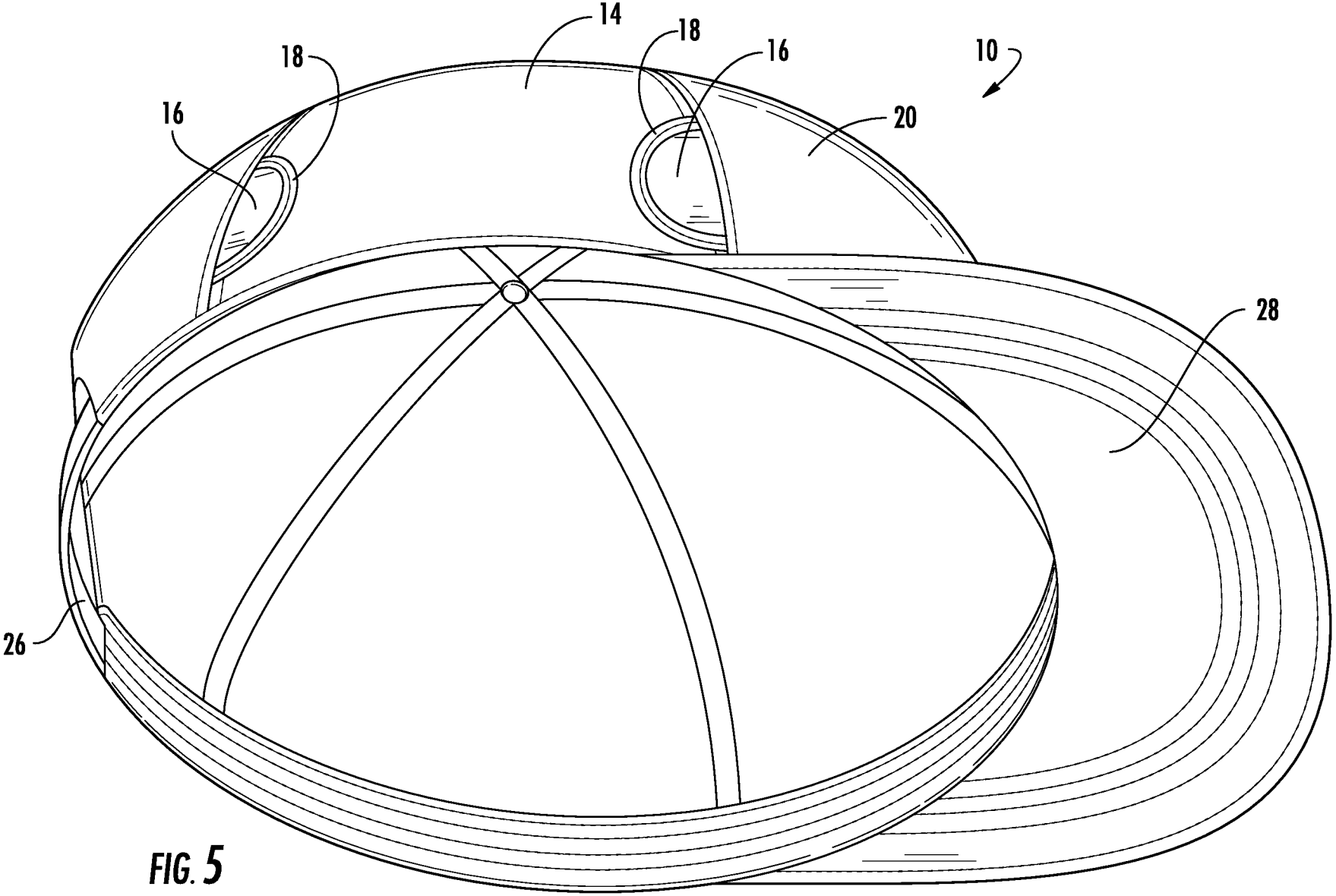
FIG. 5 is an underside side view of the article of headwear apparel having a means to attach and secure other articles, depicted in FIG. 1.
Figure 6:
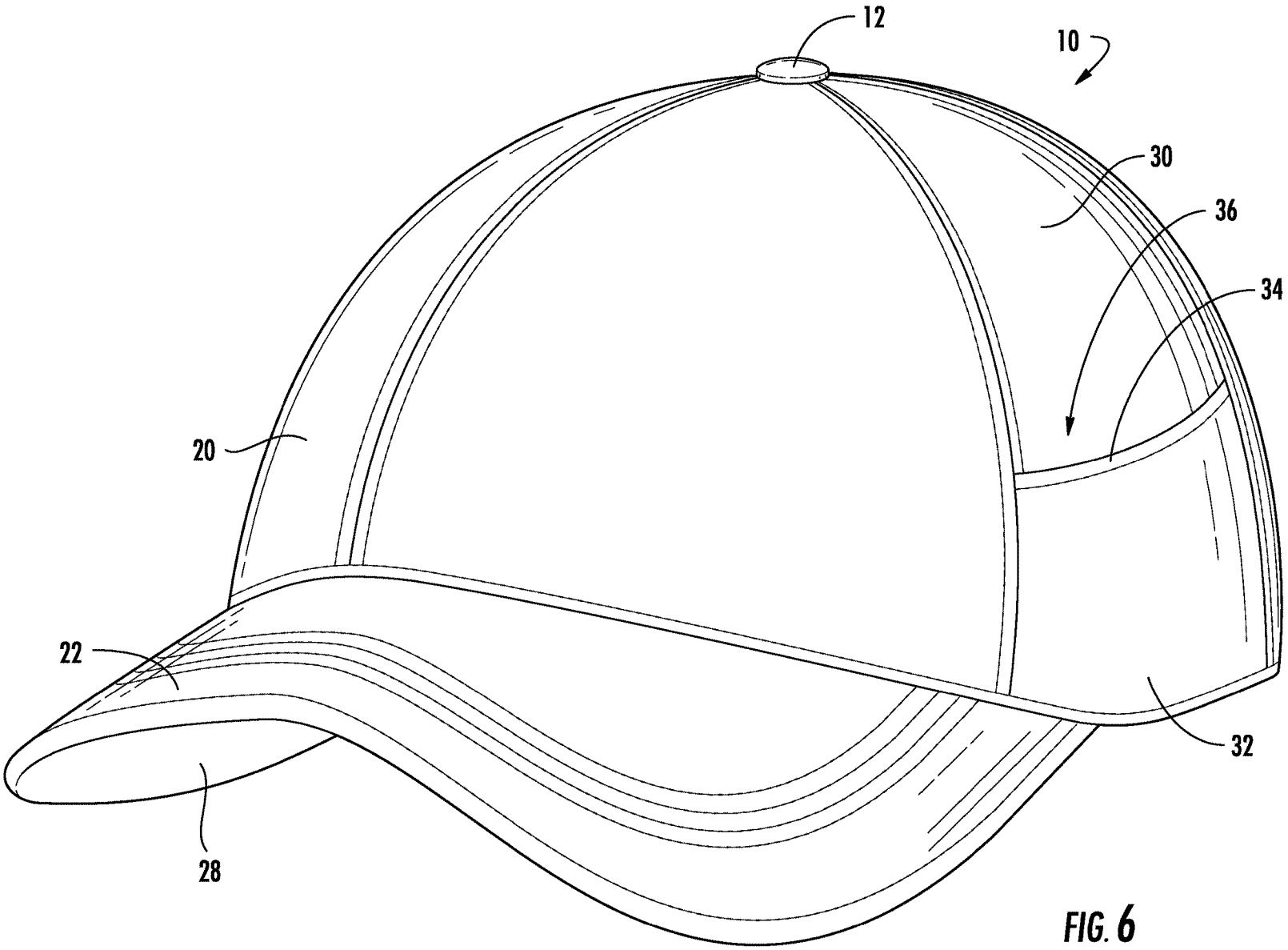
FIG. 6 is a front perspective view of an article of headwear apparel having a means to attach and secure other articles, illustrating, in particular, a vertical pocket constructed in a two-ply assembly of the headwear apparel, according to an embodiment of the technology described herein.
Figure 7:
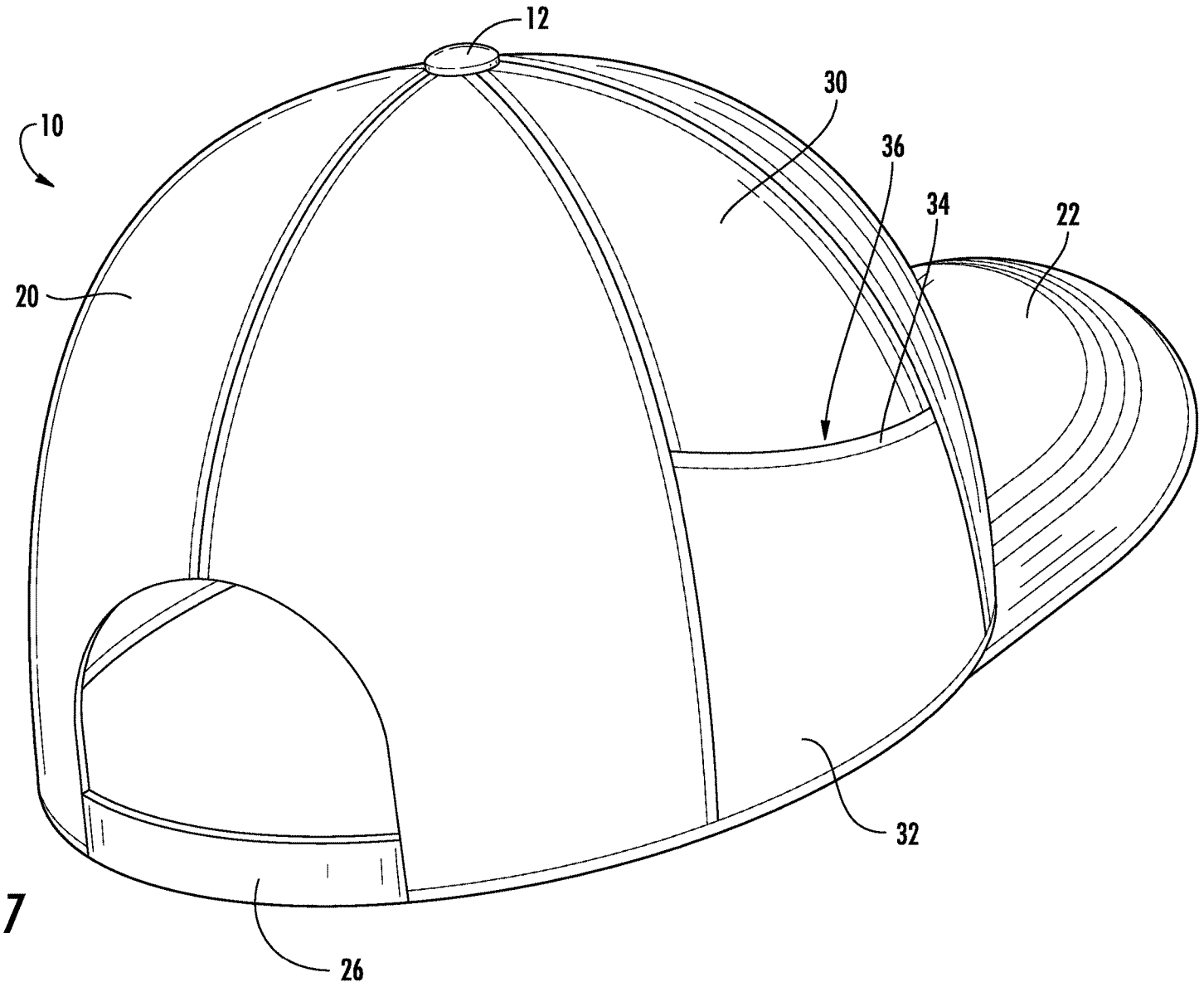
FIG. 7 is a rear perspective view of the article of headwear apparel having a means to attach and secure other articles, depicted in FIG. 2, illustrating, in particular, a vertical pocket constructed in a two-ply assembly of the headwear apparel, according to an embodiment of the technology described herein.
Figure 8:
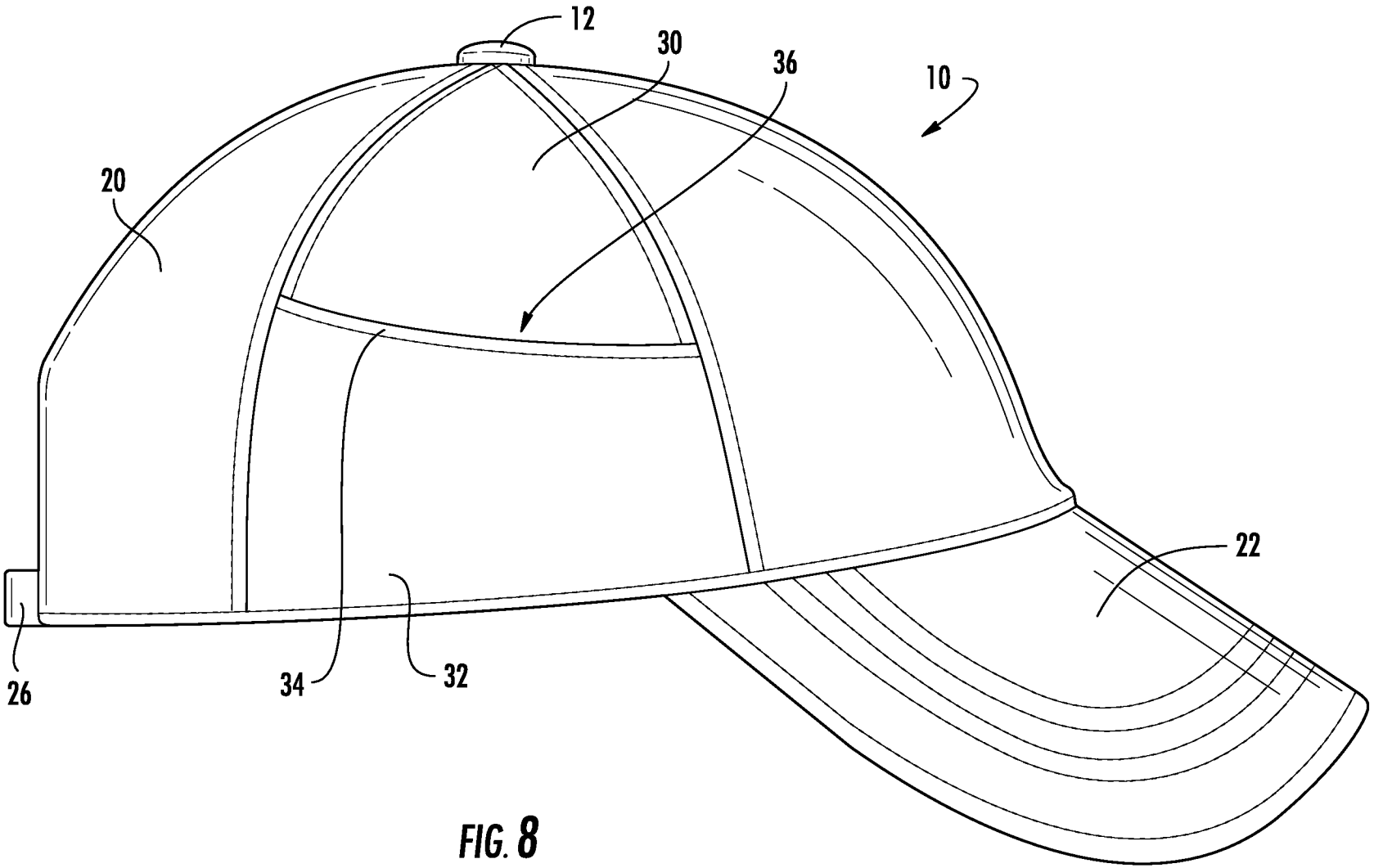
FIG. 8 is a side view of the article of headwear apparel having a means to attach and secure other articles, depicted in FIG. 6.
Figure 9:
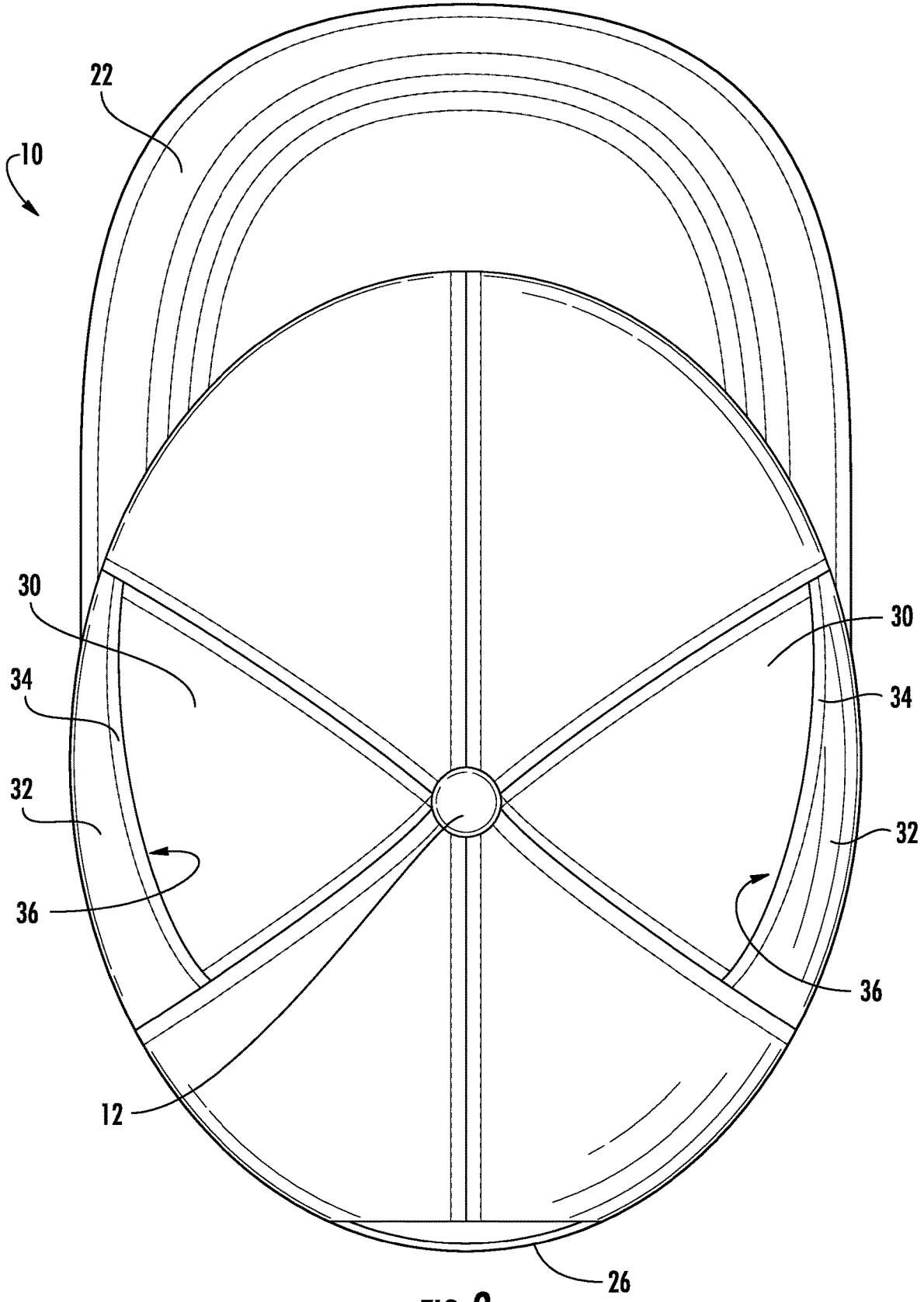
FIG. 9 is a top view of the article of headwear apparel having a means to attach and secure other articles, depicted in FIG. 6.
Figure 10:
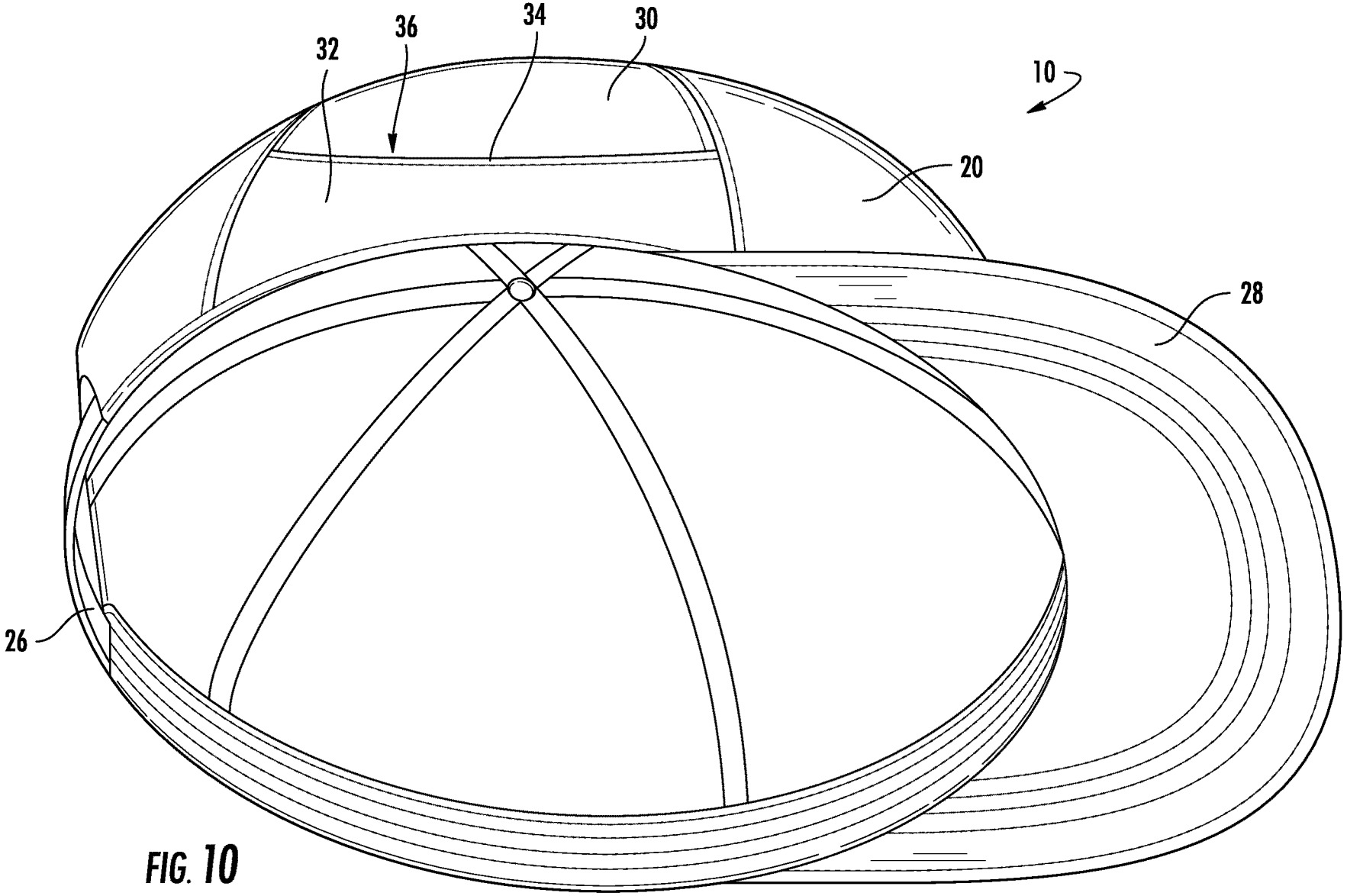
FIG. 10 is an underside side view of the article of headwear apparel having a means to attach and secure other articles, depicted in FIG. 6.

In at least one embodiment, the headwear device further includes a plurality of seams (FIG. 5, underside) to couple the plurality of panels coupled together adjacently thereby to collectively form the crown.

In another exemplary embodiment, technology described herein provides a headwear device 10 for securing articles. The headwear device includes: a crown; a right front panel; a left front panel; a right side panel; a left side panel; a right back panel; and a left back panel. The right front panel, the left front panel, the right side panel, the left side panel, the right back panel, and the left back panel are coupled together adjacently thereby to collectively form the crown. The headwear device includes a visor attached to the crown. The right side panel and the left side panel are defined as a two-ply panel comprising an interior panel and an exterior panel, sandwiched together to collectively form the two-ply panel within the headwear device. The at least two apertures are defined within each of the right side panel and the left side panel, wherein a first aperture defines an entry point for an object on an external side of the headwear device and wherein a second aperture defines an exit point on the external side of the headwear device such that the object is passed through the sleeve without entering an internal portion of the headwear device.

In yet another exemplary embodiment, technology described herein provides a headwear device 10 for securing articles. The headwear device includes: a crown; a right front panel; a left front panel; a right side panel; a left side panel; a right back panel; and a left back panel. The right front panel, the left front panel, the right side panel, the left side panel, the right back panel, and the left back panel are coupled together adjacently thereby to collectively form the crown. The headwear device includes a visor attached to the crown. The right side panel and the left side panel are defined as a two-ply panel comprising an interior panel and an exterior panel, sandwiched together to collectively form the two-ply panel within the headwear device. A vertical pocket is defined within at least one of the right side panel and the left side panel, wherein the vertical pocket is defined by the at least one aperture defined within the at least one two-ply panel thereby to form an upward-facing entry point to an interior portion of the at least one two-ply panel.

Figure 13:
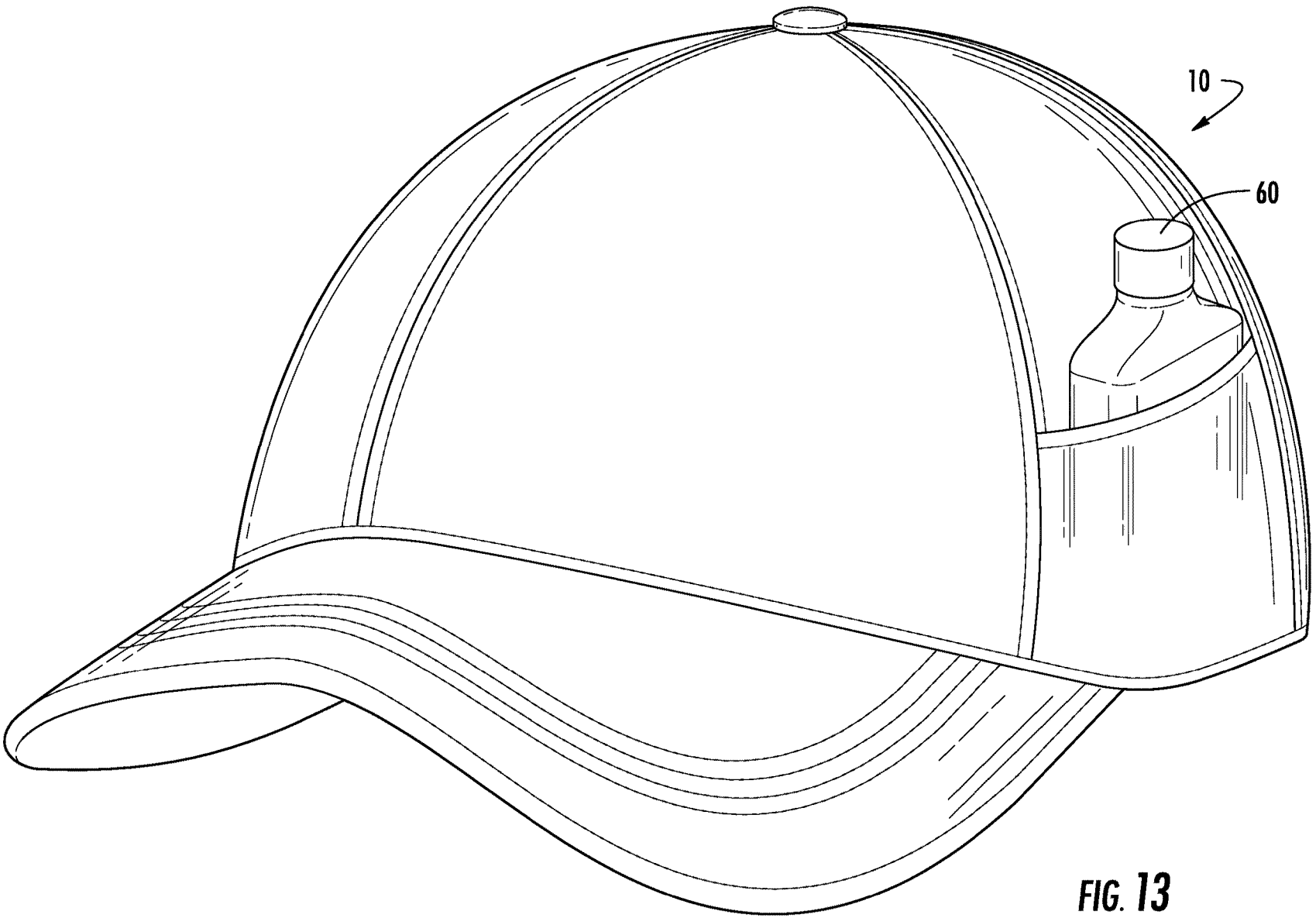
FIG. 13 is front perspective view of the article of headwear apparel having a means to attach and secure other articles, depicted in FIG. 6, illustrating, in particular, a vial of sunblock lotion mounted with the means to attach and secure other articles, according to an embodiment of the technology described herein.

In use the headwear device 10 is used to hold, by way of example and not of limitation, a flashlight (40 in FIG. 11), a carpenter's pencil (50 in FIG. 12), and a vial (60 in FIG. 13). Other items to secure can include, for example, a key, a credit card and license, a golf tee, a golf tool, sunglasses, a house key, a bottle opener, a bottle of sunblock, a hunting flashlight, a tobacco product, and so forth. The cap could be used by construction workers, craftsmen, plumbers, electricians, runners, bartenders, bar & grill waiters, golfers, hunters, or a parcel delivery person.

Advantageously, and for safety reasons, the cap pocket sleeve allows for a marking device to be placed in the cap but away from the wearer's eyes. Also, advantageously, and for practical reasons, the cap pocket sleeve allows for a flashlight to be placed in the cap, so a worker can have hands-free use of the light. Also, advantageously, the cap's pocket sleeve design allows for the wearer to utilize its function whether they are left or right handed, or whether they wear the hat frontward or backward. Also, advantageously, the cap's pocket sleeve with its two-ply cap panel formation is a subtler design.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A headwear device for securing articles with a pass-through sleeve, the headwear device comprising:

a crown;

a plurality of panels coupled together adjacently thereby to collectively form the crown;

a top button disposed on the top of the crown at a point of intersection of the plurality of panels;

a visor attached to the crown;

at least one two-ply panel having an interior panel and an exterior panel, both the interior and exterior panels of the two-ply panel extending downwardly from the top button to a base of the headwear device, integrally formed and to share substantially a plurality of edge seams extending downwardly from the top button to a base of the headwear device, and disposed within the crown portion of the headwear device as a portion of the plurality of panels coupled together adjacently;

at least one entry aperture defined within the at least one two-ply panel thereby to form an entry point to an interior portion of the at least one two-ply panel; and at least one exit aperture, defined within the at least one two-ply panel thereby to form a sleeve, wherein the entry aperture defines an entry point for an object on an external side of the headwear device and wherein an exit aperture defines an exit point on the external side of the headwear device such that the object is passed through the sleeve without entering an internal portion of the headwear device;

wherein the at least one entry aperture and the at least one exit aperture are reversible to allow alternate use with entry at the exit aperture and exit at the entry aperture;

wherein the at least one entry aperture and the at least one exit aperture defined within the at least one two-ply panel thereby to form a pass-through sleeve are positioned such that the pass-through sleeve is horizontal relative to the headwear device; and wherein the exterior panel is less in size than the interior panel at the at least one entry aperture and the at least one exit aperture defined within the at least one two-ply panel thereby to create at least one indentation to a portion of at least one of the plurality of edge seams defined at each of the at least one entry aperture and the at least one exit aperture and aid in ease of entry.

2. The headwear device of claim 1, further comprising:

a vertical pocket, wherein the vertical pocket is defined by the at least one aperture defined within the at least one two-ply panel thereby to form an upward-facing entry point to an interior portion of the at least one two-ply panel.

3. The headwear device of claim 1, further comprising:

wherein the at least one two-ply panel disposed within the crown portion of the headwear device as a portion of the plurality of panels coupled together adjacently further comprises an interior panel and an exterior panel, sandwiched together to collectively form a panel within the headwear device.

4. The headwear device of claim 1, wherein the at least one entry aperture and the at least one exit aperture defined within the at least one two-ply panel thereby to form a sleeve are further defined with an edge seam on an external panel of the two-ply panel to add structural integrity.

5. The headwear device of claim 1, wherein the plurality of panels coupled together adjacently thereby to collectively form the crown further comprise:

a right front panel;

a left front panel;

a right side panel;
a left side panel;
a right back panel; and
a left back panel; and
wherein the right side panel and the left side panel each are defined as a two-ply panel;
at least one entry apertures and at least one exit aperture are defined within each of the right side panel and the left side panel, wherein a first aperture defines an entry point for an object on an external side of the headwear device and wherein a second aperture defines an exit point on the external side of the headwear device such that the object is passed through the sleeve without entering an internal portion of the headwear device.

6. The headwear device of claim 1, wherein the plurality of panels coupled together adjacently thereby to collectively form the crown further comprise:
a right front panel;
a left front panel;
a right side panel;
a left side panel;
a right back panel; and
a left back panel; and
wherein at least one the right side panel and the left side panel is defined as a two-ply panel;
a vertical pocket defined within at least one of the right side panel and the left side panel, wherein the vertical pocket is defined by the at least one aperture defined within the at least one two-ply panel thereby to form an upward-facing entry point to an interior portion of the at least one two-ply panel.

7. The headwear device of claim 1, wherein the plurality of panels coupled together adjacently thereby to collectively form the crown further comprise:
a right front panel;
a left front panel;
a right side panel;
a left side panel;
a right back panel; and
a left back panel; and
wherein the right side panel and the left side panel each are defined as a two-ply panel;
a vertical pocket defined within each of the right side panel and the left side panel, wherein the vertical pocket is defined by the at least one aperture defined within the at least one two-ply panel thereby to form an upward-facing entry point to an interior portion of the at least one two-ply panel.

8. The headwear device of claim 1, wherein the plurality of panels coupled together adjacently thereby to collectively form the crown further comprise:
a right front panel;
a left front panel;
a right side panel;
a left side panel;
a right back panel; and
a left back panel; and
wherein at least one of the right front panel, the left front panel, the right side panel, the left side panel, the right back panel, and the left back panel is defined as a two-ply panel; and
wherein the at least one panel defined as a two-ply panel comprises a vertical pocket defined within panel, wherein the vertical pocket is defined by the at least one aperture defined within the at least one two-ply panel thereby to form an upward-facing entry point to an interior portion of the at least one two-ply panel.

9. The headwear device of claim 1, wherein the plurality of panels coupled together adjacently thereby to collectively form the crown further comprise:
a right front panel;
a left front panel;
a right side panel;
a left side panel;
a right back panel; and
a left back panel; and
wherein the right front panel and the left front panel each are defined as a two-ply panel;
at least one entry aperture and at least one exit aperture defined within each of the right front panel and the left front panel.

10. The headwear device of claim 1, wherein the plurality of panels coupled together adjacently thereby to collectively form the crown further comprise:
a right front panel;
a left front panel;
a right side panel;
a left side panel;
a right back panel; and
a left back panel; and
wherein the right back panel and the left back panel each are defined as a two-ply panel;
at least one entry aperture and at least one exit aperture defined within each of the right front panel and the left front panel.

11. The headwear device of claim 1, wherein the plurality of panels coupled together adjacently thereby to collectively form the crown further comprise:
a right front panel;
a left front panel;
a right side panel;
a left side panel;
a right back panel; and
a left back panel; and
wherein at least one of the wherein at least two of the right front panel, the left front panel, the right side panel, the left side panel, the right back panel, and the left back panel are defined as a two-ply panel; and
wherein a first panel defined as a two-ply panel comprises a vertical pocket defmed within panel, wherein the vertical pocket is defined by the at least one entry aperture defined within the at least one two-ply panel thereby to form an upward-facing entry point to an interior portion of the at least one two-ply panel; and
wherein a second panel defined as a two-ply panel comprises at least one entry apertures and at least one exit aperture defined within the second panel and the left side panel, wherein a first aperture defines an entry point for an object on an external side of the headwear device and wherein a second aperture defines an exit point on the external side of the headwear device such that the object is passed through the sleeve without entering an internal portion of the headwear device.

12. The headwear device of claim 1, the visor further comprising:
at least one visor-type two-ply panel disposed within the visor of the headwear device; and
at least one entry aperture defined within the at least one visor-type two-ply panel thereby to form an entry point to an interior portion of the at least one visor-type two-ply panel.

13. The headwear device of claim 1, wherein the at least one two-ply panel disposed within the crown portion of the headwear device as a portion of the plurality of panels coupled together adjacently further comprises an interior panel and an exterior panel, sandwiched together to collectively form a panel within the headwear device; and wherein the exterior panel is of a shape smaller and dissimilar in pattern, such that a portion of the interior panel is visible.

14. The headwear device of claim 1, further comprising:

a closure on a back portion of the headwear device coupled to at least two of the plurality of panels.

15. The headwear device of claim 1, further comprising:

a plurality of seams to couple the plurality of panels coupled together adjacently thereby to collectively form the crown.

16. A headwear device for securing articles, with a pass-through sleeve, the headwear device comprising:

a crown;

a right front panel;

a left front panel;

a right side panel;

a left side panel;

a right back panel; and a left back panel; and a top button disposed on the top of the crown at a point of intersection of the plurality of panels;

wherein the right front panel, the left front panel, the right side panel, the left side panel, the right back panel, and the left back panel are coupled together adjacently thereby to collectively form the crown;

a visor attached to the crown;

wherein the right side panel and the left side panel are defined as a two-ply panel comprising an interior panel and an exterior panel, both the interior and exterior panels of the two-ply panel extending downwardly from the top button to a base of the headwear device, integrally formed and to share substantially a plurality of edge seams extending downwardly from the top button to a base of the headwear device, sandwiched together to collectively form the two-ply panel within the headwear device;

at least one entry apertures and at least one exit aperture are defined within each of the right side panel and the left side panel, wherein the entry aperture defines an entry point for an object on an external side of the headwear device and wherein the exit aperture defines an exit point on the external side of the headwear device such that the object is passed through the sleeve without entering an internal portion of the headwear device;

wherein the entry aperture defines an entry point for an object on an external side of the headwear device and wherein an exit aperture defines an exit point on the external side of the headwear device such that the object is passed through the sleeve without entering an internal portion of the headwear device;

wherein the at least one entry aperture and the at least one exit aperture are reversible to allow alternate use with entry at the exit aperture and exit at the entry aperture;

wherein the at least one entry aperture and the at least one exit aperture defined within the at least one two-ply panel thereby to form a pass-through sleeve are positioned such that the pass-through sleeve is horizontal relative to the headwear device; and wherein the exterior panel is less in size than the interior panel at the at least one entry aperture and the at least one exit aperture defined within the at least one two-ply panel thereby to create at least one indentation to a portion of at least one of the plurality of edge seams defined at each of the at least one entry aperture and the at least one exit aperture and aid in ease of entry.

* * * * *